US007124508B2

(12) United States Patent
Hasegawa

(10) Patent No.: US 7,124,508 B2
(45) Date of Patent: Oct. 24, 2006

(54) SCISSOR CAP AND SCISSORS

(75) Inventor: Katsuhiko Hasegawa, Gifu-ken (JP)

(73) Assignee: Hasegawa Hamono Kabushiki Kaisha, Seki (JP)

( * ) Notice: Subject to any disclaimer, the term of this patent is extended or adjusted under 35 U.S.C. 154(b) by 241 days.

(21) Appl. No.: 10/771,825

(22) Filed: Feb. 4, 2004

(65) Prior Publication Data

US 2004/0158993 A1 Aug. 19, 2004

(30) Foreign Application Priority Data

Feb. 18, 2003 (JP) ..... 2003-040291
Jun. 6, 2003 (JP) ..... 2003-162223

(51) Int. Cl.
*B26B 13/00* (2006.01)

(52) U.S. Cl. ..... 30/143; 30/151; 30/233

(58) Field of Classification Search ..... 30/233, 30/254, 261, 341, 151, 143; 206/349; D8/51, D8/57

See application file for complete search history.

(56) References Cited

U.S. PATENT DOCUMENTS

| | | | | |
|---|---|---|---|---|
| 1,279,389 | A * | 9/1918 | Malsin | 30/233 |
| 1,870,025 | A * | 8/1932 | Rauh | 30/261 |
| 2,272,753 | A * | 2/1942 | Steinhardt | 30/233 |
| 2,557,553 | A * | 6/1951 | Metzger | 30/233 |
| 2,591,740 | A * | 4/1952 | Stilwell et al. | 30/233 |
| 4,235,016 | A * | 11/1980 | Kobelt | 30/233 |
| 4,400,877 | A * | 8/1983 | Gingher, Jr. | 30/253 |
| 4,423,729 | A * | 1/1984 | Gray | 606/148 |
| 4,714,159 | A * | 12/1987 | Linden | 206/349 |
| 4,916,815 | A * | 4/1990 | Ohmura | 30/151 |
| 5,291,996 | A * | 3/1994 | Linden | 206/349 |
| 6,854,184 | B1 * | 2/2005 | DiPalma | 30/143 |

FOREIGN PATENT DOCUMENTS

| | | |
|---|---|---|
| JP | 4-32667 | 3/1992 |
| JP | 3070507 | 8/2000 |

* cited by examiner

*Primary Examiner*—Hwei-Siu Payer
(74) *Attorney, Agent, or Firm*—Colin P. Cahoon; Carstens & Cahoon, LLP

(57) ABSTRACT

A pair of scissors including a pair of scissor pieces, each having a handle and a blade, and a pin, which connects the two scissor pieces so that they may be opened and closed. The cutting edges of the two blades intersect each other at an intersecting point that moves along a predetermined movement path when the two blades are opened and closed. A cap accommodates the two blades. The cap includes an engaging slit detachably engaged with at least the pin to keep the two blades accommodated in the cap. A slit is formed in the cap. The slit is located at a portion of the cap, which accommodates the two blades, corresponding to the movement path. The scissors improves safety regardless of whether or not the scissors are being used.

19 Claims, 8 Drawing Sheets

SCISSOR CAP AND SCISSORS

BACKGROUND OF THE INVENTION

The present invention relates to scissors and to a scissor cap that enables the usage of a pair of scissors while covering the blades of the scissors.

Registered Utility Model No. 3070507 describes a pair of scissors that improves safety when the scissors are being used.

More specifically, referring to FIG. 9, a pair of scissors 51 includes two scissor pieces 52. Each scissor piece 52 includes a blade 53 and a handle 54. A pin 55 supports the two scissor pieces 52 so that the scissor pieces 52 may be opened or closed, that is, moved away from or toward each other. A cover 56 is formed integrally with one of the handles 54 (i.e., handle 54*a*). The cover 56 includes a hollow portion 57. When the other one of the handles 54 (i.e., handle 54*b*) is moved away from the handle 54*a*, the blade 53*b* connected to the handle 54*b* enters the hollow portion 57. The other blade 53*a* has a distal end covered by a cap 58. To use the scissors 51, the two scissor pieces 52 are opened. In this state, an object, such as paper, is placed between the blade 53*a* and the opening of the hollow portion 57. The two scissor pieces 52 are then closed and opened to cut the object. The cover 56 prevents a person's finger from getting caught between the blades 53*a* and 53*b* when using the scissors 51.

There are known scissor caps used to improve the safety of the scissors when the scissors are not being used. The cap accommodates the scissor blades in a closed state. Utility Model Laid-Open Publication No. 4-32667 describes an example of such scissors that improve safety when the scissors are not being used.

More specifically, referring to FIG. 10, a pair of scissors 61 includes two scissor pieces 62. Each scissor piece 62 includes a blade 63 and a handle 64. A pin 65 supports the two scissor pieces 62 so that the scissor pieces 62 may be opened or closed, that is, moved away from or toward each other. A spring 66 is arranged in the scissors 61 near the pin 65 to urge the two scissor pieces 62 in an opening direction. The scissors 61 are entirely accommodated in a case 67 when not being used. An opening 67*a* extends through one longitudinal side of the case 67. Openings 67*b* and 67*d* respectively extend through the two lateral sides of the case 67. The opening 67*b* functions to expose a slip-guard (not shown) arranged on an outer surface of one of the handles 64 (i.e., the upper handle 64*a* as viewed in FIG. 10). A guide 67*c* is arranged on the inner wall of the case 67 to guide the movement of the handle 64*a*, which has the slip-guard, in the longitudinal direction of the case 67. As shown in the state of FIG. 10, the case 67 entirely covers the scissors 61 when the scissors 61 are not in use. From this state, to use the scissors 61, the handle 64*a*, the slip-guard of which is exposed from the opening 67*b*, is moved along the guide 67*c* in the longitudinal direction of the case 67 (toward the left as viewed in FIG. 10). As a result, the other handle 64*b*, which is urged toward the inner wall of the case 67 by the urging force of the spring 66, is released from the inner wall and popped out of the opening 67*d*. Further, the two blades 63 project out of the case 67 from the opening 67*a*. When the handle 64*b* is in contact with the wall of the case 67, the two blades 63 are overlapped with each other and closed. However, when the handle 64*b* pops out of the opening 67*d*, the blades 63 are opened to enable cutting. Accordingly, an object is cut by moving the handles 64*a* and 64*b* toward each other against the urging force of the spring 66 and away from each other with the urging force.

In the scissors 51 of Registered Utility Model No. 3070507, the cover 56 is formed integrally with the handle 54*a*, and the cover 56 cannot be removed from the scissors 51. That is, the cover 56 is not removable from the scissors 51 and is used exclusively for the scissors 51. Accordingly, the cover 56 cannot be used for other scissors. Further, in the scissors 51, the other blade 53*a* is always exposed. Accordingly, it is believed that further improvements may be made to the scissors 51 from the perspective of safety.

Further, in the scissors 61 of Utility Model Laid-Open Publication No. 4-32667, the entire scissors 61 are accommodated in the case 67, and the case 67 cannot be used for other scissors. In addition, when using the scissors 61, the two blades 63 project out of the case 67 and are exposed. Accordingly, it is believed that further improvements may be made to the scissors 61 from the perspective of safety.

SUMMARY OF THE INVENTION

One aspect of the present invention is a cap for a pair of scissors. The scissors includes two scissor pieces, each having a handle and a blade provided with a cutting edge. A pin connects the two scissor pieces so as to enable the scissor pieces to be opened and closed. The cutting edges of the two blades intersect each other at an intersecting point that moves along a predetermined movement path when the two blades are opened and closed. The cap includes a cap body for accommodating the two blades. An engaging portion is detachably engaged with at least one of the pin and either one of the scissor pieces to keep the two blades accommodated in the cap body. A slit is formed in the cap body. The slit is located at a portion of the cap body, which accommodates the two blades, corresponding to at least part of the movement path.

A further aspect of the present invention is a pair of scissors including two scissor pieces, each having a handle and a blade provided with a cutting edge. A pin connects the two scissor pieces so as to enable the scissor pieces to be opened and closed. The cutting edges of the two blades intersect each other at an intersecting point that moves along a predetermined movement path when the two blades are opened and closed. A cap accommodates the two blades. The cap includes an engaging portion detachably engaged with at least one of the pin and either one of the scissor pieces to keep the two blades accommodated in the cap. A slit is formed in the cap. The slit is located at a portion of the cap, which accommodates the two blades, corresponding to at least part of the movement path.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 3(*b*) is a cross-sectional view taken along line 3*b*—3*b* of FIG. 3(*a*);

FIG. 6(*b*) is a partially cutaway side view showing the vicinity of the pin of the scissors of FIG. 6(*a*);

FIG. 7(*b*) is a side view showing the scissor cap of FIG. 7(*a*);

DETAILED DESCRIPTION OF THE PREFERRED EMBODIMENTS

A first embodiment according to the present invention will now be discussed with reference to FIGS. 1 to 5.

Figure 1:
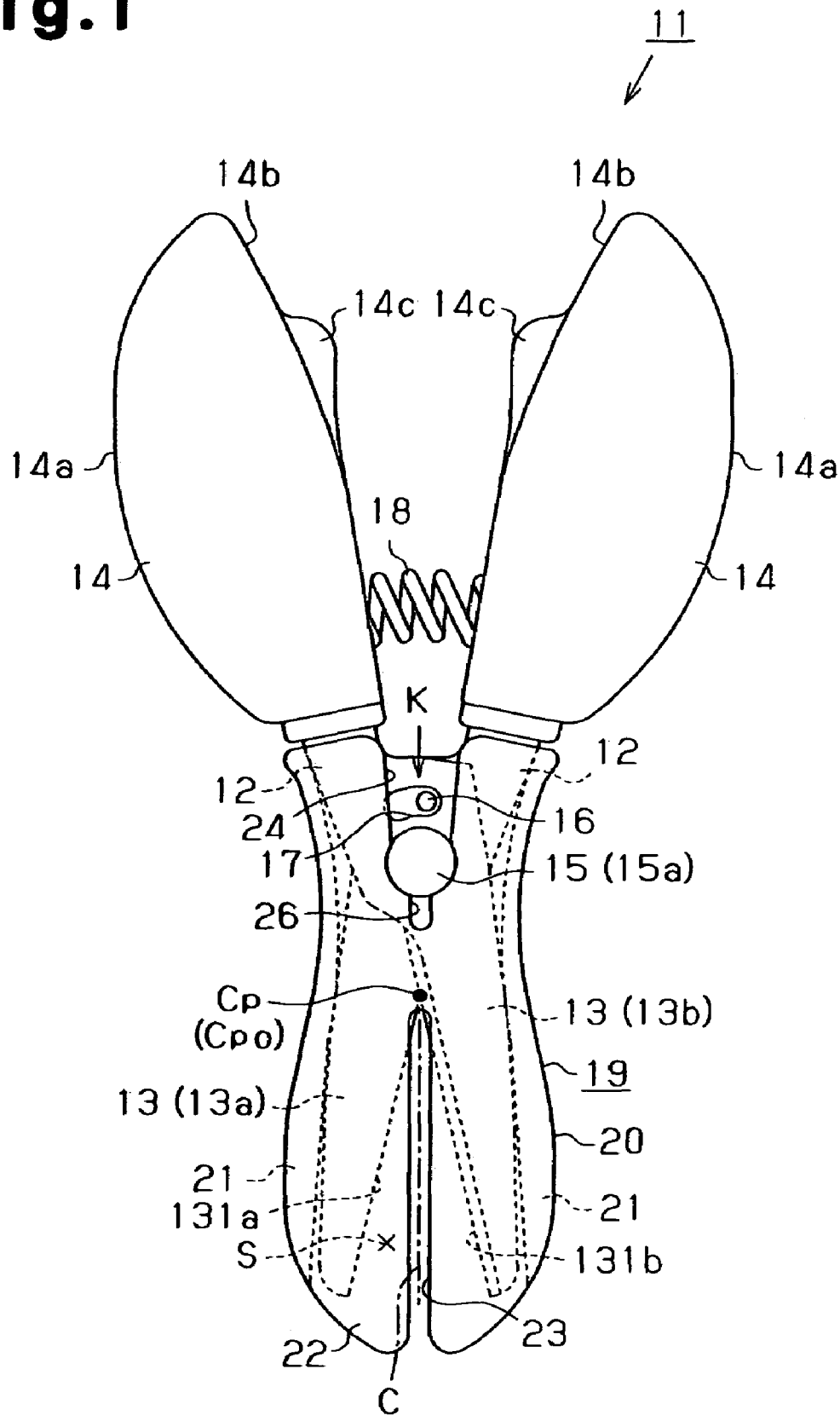
FIG. 1 is a plan view showing a scissor cap according to a first embodiment of the present invention in a state accommodating the blades of a pair of scissors.
Figure 2:
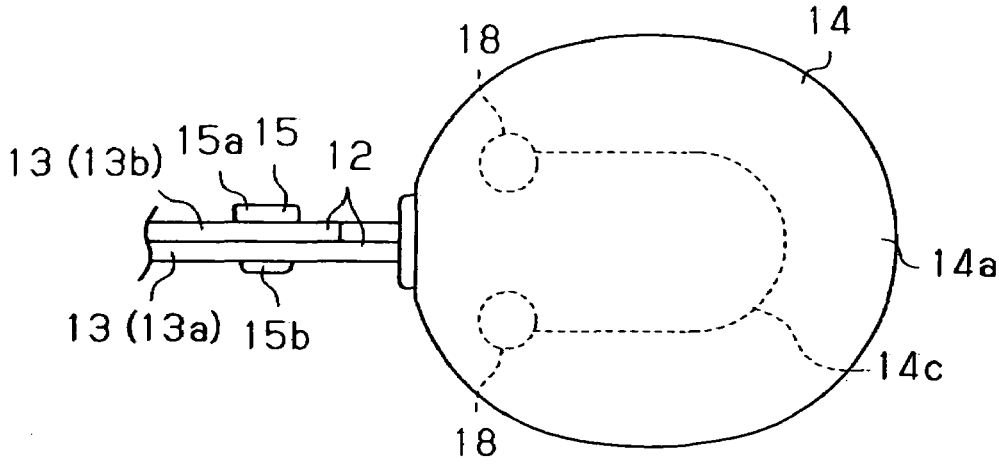
FIG. 2 is a partially cutaway side view showing the scissors of FIG. 1.
Figure 4:
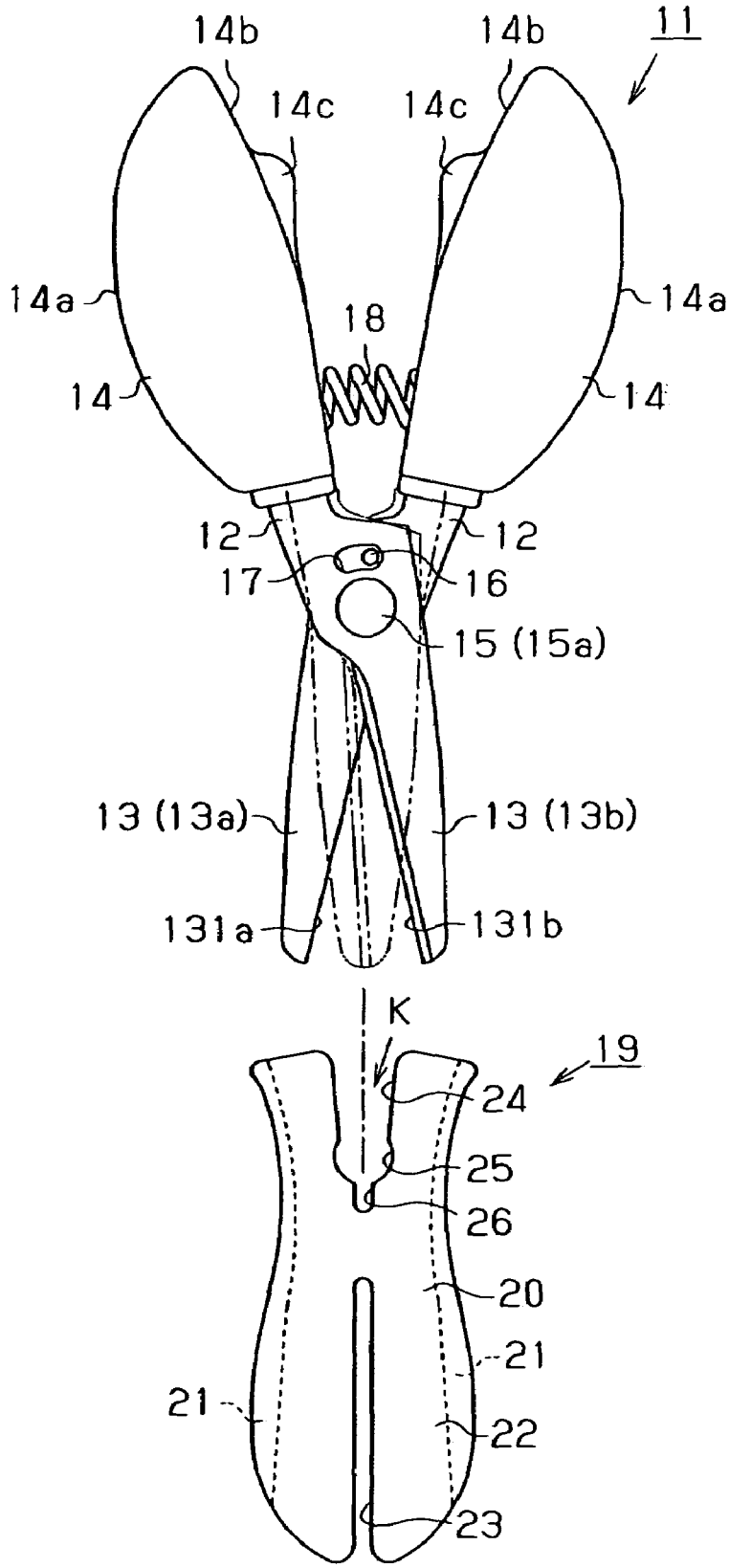
FIG. 4 is a plan view showing the scissors and the scissor cap of FIG. 1 before the blades of the scissors are accommodated in the scissor cap.

Referring to FIGS. 1 and 4, in the first embodiment, a pair of scissors 11 includes two scissor pieces 12. Each scissor piece 12 includes a metal (e.g., stainless steel) blade 13 and a wooden handle 14 connected to the blade 13. The blade 13 is located on the distal side of the scissors 11 and the handle 14 is located on the basal side of the scissors 11. The blade 13 and the handle 14 do not have to be made of the above materials and may be made of any material. A pin 15 pivotally supports the scissor pieces 12 at the longitudinally middle portion of the scissor pieces 12 to enable the scissor pieces 12 to be moved away and toward each other, or to be opened and closed. Referring to FIG. 2, the pin 15 extends through the two scissor pieces 12 and has two round heads 15*a* and 15*b* located on opposite sides of the pin 15. The head 15*b* is crimped to fasten the two scissor pieces 1 to each other so that the scissor pieces 12 may be opened and closed. The diameter and thickness of the head 15*a* are greater than those of the head 15*b*.

Referring to FIGS. 1 and 4, a projection 16 projects from one of the two blades 13, or a first blade 13*a*. The projection 16 is formed integrally with the first blade 13*a* and located on the basal side of the pin 15. A slide groove 17 extends through the other one of the two blades 13, or a second blade 13*b*, at a location corresponding to the projection 16. When the scissor pieces 12 are opened and closed, the projection 16 is guided along the slide groove 17. Accordingly, the slide groove 17 restricts the range in which the two scissor pieces can be opened.

Referring to FIGS. 1 and 2, the two handles 14 each have a semispherical portion 14*a*, an opposing surface 14*b*, and a stopper 14*c*. The semispherical portion 14*a* is located on the outer side of the handle 14, the opposing surface 14*b* opposes the opposing surface 14*b* of the other handle 14, and the stopper 14*c* projects from the opposing surface 14*b*. When the two scissor pieces 12 are closed, the stoppers 14*c* hit each other and produces a sound. That is, the handles 14 produce sounds using the principle employed by a castanet. Two urging members, or coil springs 18, are arranged between the opposing surfaces 14*b* of the handles 14. The ends of the two coil springs 18 are arranged on each side of a hypothetical plane that includes the edges of the blades 13*a* and 13*b* and are separated from the hypothetical plane by the same distance (refer to FIG. 2). The two coil springs 18 urge the two scissor pieces 12 in the direction in which the scissor pieces 12 are opened. Accordingly, the two scissor pieces 12 are opened when a force for closing the scissor pieces 12 is not applied thereto. In such a state, the two scissor pieces 12 are opened to a maximum angle, which is restricted by the slide groove 17.

A scissor cap 19, which accommodates the two blades 13*a* and 13*b* of the scissors 11 will now be discussed with reference to FIG. 3.

Figure 3A:
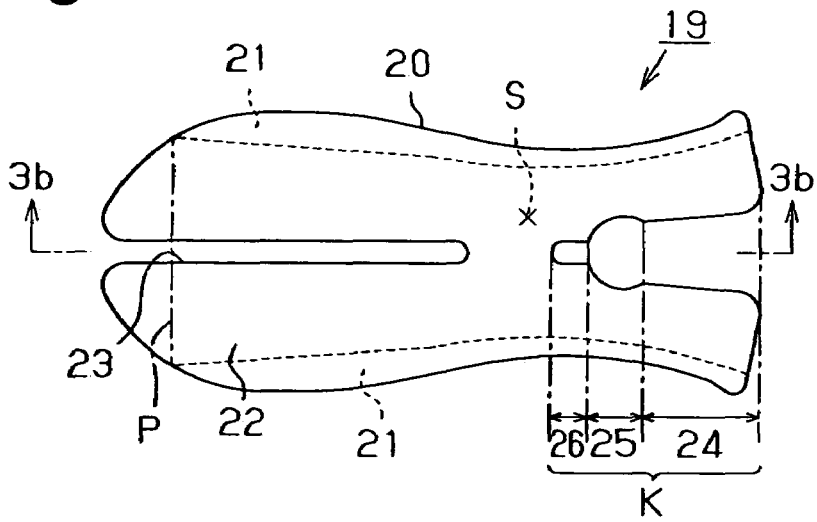
FIG. 3(*a*) is a plan view showing the scissor cap of FIG. 1.
Figure 3B:
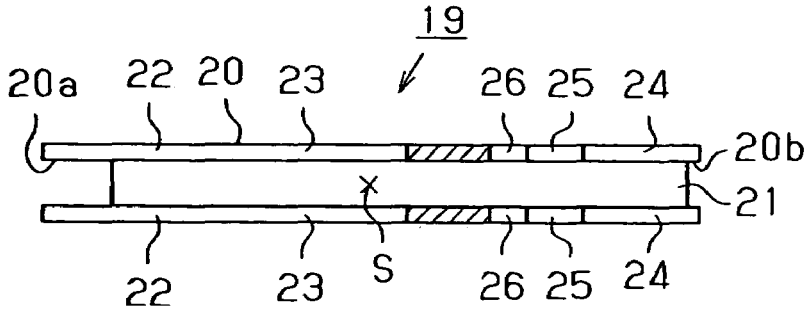

Referring to FIGS. 3(*a*) and 3(*b*), the scissor cap 19 has a tubular cap body 20, which includes a distal opening 20*a* and a basal opening 20*b*. The cap body 20 is made of a transparent synthetic resin. However, the cap body 20 does not have to be made of resin and may be made of any material, such as wood.

The cap body 20 has curved sides that partially narrow the cap body 20. Further, the cap body 20 includes two side walls 21 extending along the sides of the cap body 20 with respect to the lateral direction of the cap body 20. The lateral direction of the cap body 20 refers to a direction perpendicular to the axis of the pin 15 (the lateral direction in FIG. 1). Two cover walls 22 extend between the side walls 21 and are spaced from each other by a predetermined distance in a direction perpendicular to the cap body 20. The direction perpendicular to the cap body 20 refers to a direction parallel to the axis of the pin 15. The basal portions of the two side walls 21 are curved toward each other. The cover walls 22 are plate-like and have lateral edges shaped in correspondence with the side walls 21. The distal sides of the two cover walls 22 are curved outward from a hypothetical plane P, which connects the distal ends of the side walls 21. A distal slit 23 extends longitudinally straight through the center of each cover wall 22 from the distal end to the middle portion of the cover wall 22 so as to divide the cover wall 22 into two halves. The distal slit 23 has a uniform width with respect to the longitudinal direction.

The basal sides of the two cover walls 22 each include an engaging slit (engaging portion) K. The pin 15 of the scissors 11 is detachably engaged with the engaging slit K. The engaging slit K includes a guiding portion 24, which is located at the basal side of the engaging slit K, a cutout portion 26, which is located at the distal side of the engaging slit K, and a holding portion 25, which is located between the guiding portion 24 and the cutout portion 26.

The guiding portion 24 extends longitudinally through the center of each cover wall 22 from the basal end thereof. The guiding portion 24 widens towards the basal end of the cover wall 22. The width of the basal end of the guiding portion 24 is greater than the diameter of the head 15*a* of pin 15 of the scissors 11. The width at the distal end of the guiding portion 24 is slightly smaller than the diameter of the head 15*a*.

The holding portion 25 is formed by cutting out the distal side of the guiding portion 24 in a semicircular manner. The diameter of the holding portion 25 is greater than the width of the distal side of the guiding portion 24 and about the same as the diameter of the head 15*a* of the pin 15. The cutout portion 26 extends longitudinally through the center of each cover wall 22 from the distal side of the holding portion 25 to the middle portion of the cover wall 22. The width of the cutout portion 26 is about the same as that of the distal slit 23. Each cover wall 22 is divided into two halves by the distal slit 23, the guiding portion 24, the holding portion 25, and the cutout portion 26. The portion of the cover wall 22 extending between the distal slit 23 and the cutout portion 26 connects the halves to each other.

A retaining space S is defined in the cap body 20 between the two side walls 21 and the two cover walls 22. The blades 13*a* and 13*b* of the scissors 11 are retained in the retaining space S (refer to FIG. 1). Due to the shape of the side walls 21, the retaining space S is narrow near the distal side of the holding portion 25. In the scissors 11, the portion surrounding the location where the pin 15 supports the scissor pieces 12 does not move in a direction substantially perpendicular to the longitudinal direction of the scissors 11 when opening and closing the scissor pieces 12. This enables narrowing of the vicinity of the distal side of the holding portion 25, which is engaged with the head 15*a* of the pin 15 when the blades 13*a* and 13*b* are retained in the scissor cap 19.

The operation of the scissors 11 when retaining the blades 13*a* and 13*b* in the scissor cap 19 will now be discussed with reference to FIGS. 1, 4, and 5.

When the scissor pieces 12 are opened by the urging force of the two coil springs 18 (the state shown by the solid lines in FIG. 4), to close the two scissor pieces 12 (the state shown by the broken lines in FIG. 4), the handles 14 are closed against the urging force of the coil springs 18. In this state, the scissor cap 19 is moved to insert the blades 13*a* and 13*b* in the retaining space S of the cap body 20. When doing so, the guiding portion 24 guides the head 15*a* of the pin 15 of the scissors 11 to engage the head 15*a* with the holding portion 25. The guiding portion 24 functions to guide the pin 15 toward the distal side of the cap body 20. The pin 15 is detachably engaged with the holding portion 25, which functions to hold the pin 15 in the engaged state. When the guiding portion 24 guides the pin 15 to the holding portion 25, the cutout portion 26 functions to facilitate widening of the guiding portion 24 and the holding portion 25 when the guiding portion 24 guides the pin 15 to the holding portion 25. The engagement of the head 15*a* of the pin 15 with the engaging slit K, which includes the guiding portion 24, the holding portion 25, and the cutout portion 26, is performed in a direction parallel to the opening and closing directions of the blades 13*a* and 13*b*.

Figure 5:
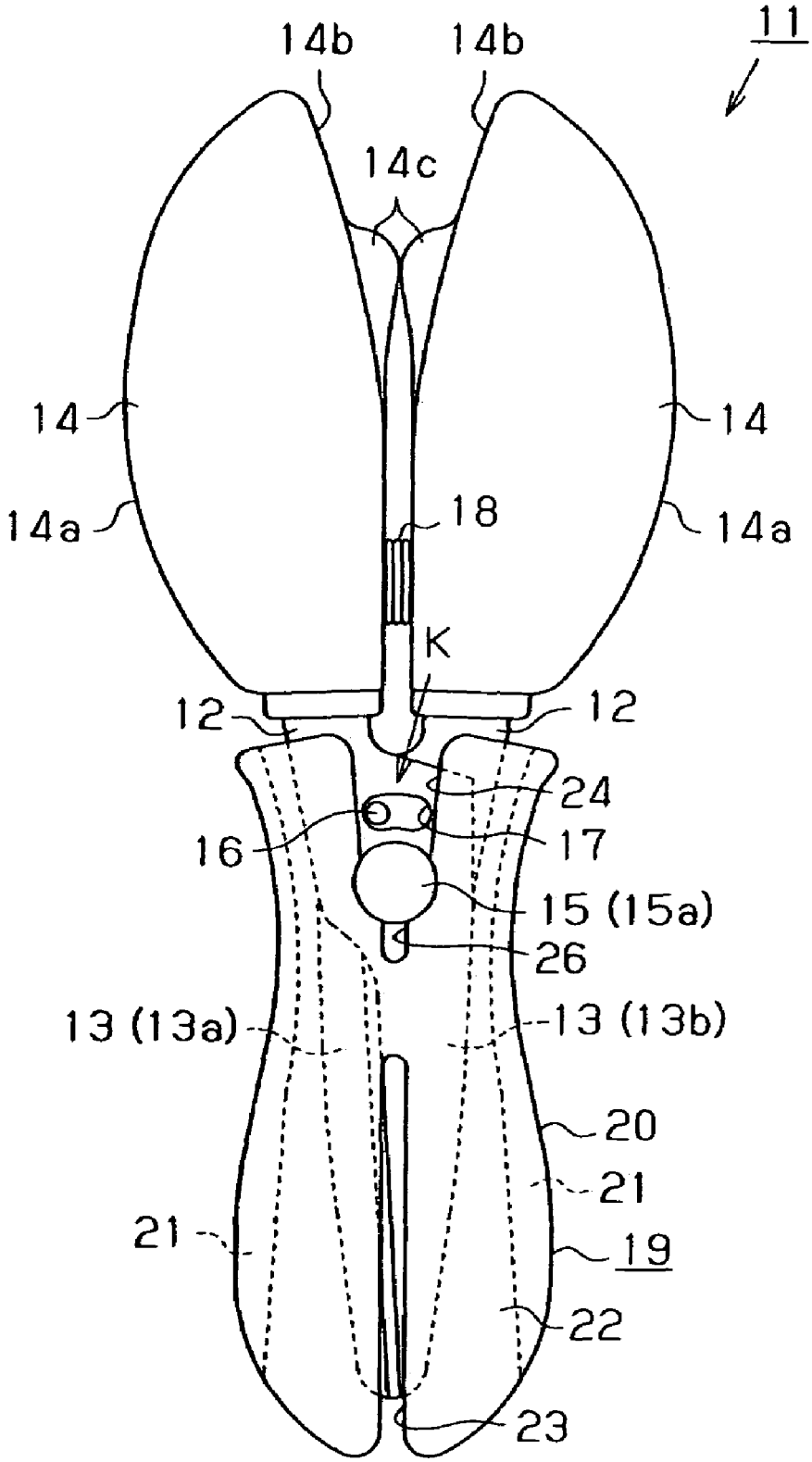
FIG. 5 is a plan view showing the scissor cap of FIG. 1 in a state accommodating the two blades of the scissors in an overlapped and closed state.

Then, when the blades 13*a* and 13*b* are retained in the cap body 20 as shown in the state of FIG. 5, the force applied to the handles 14 against the urging force of the two coil springs 18 is released. As a result, the urging force of the two coil springs 18 opens the two handles 14. This opens the scissor pieces 12 as shown in the state of FIG. 1. In this state, the two blades 13*a* and 13*b* come into contact with the inner surfaces of the side walls 21 of the cap body 20. Thus, the scissor pieces 12 are slightly closed against the urging force of the springs 18, and the angle of the two scissor pieces 12 is slightly smaller than the maximum angle. Accordingly, the angle of the opened scissor pieces 12 in this state is determined by the distance between the inner surfaces of the two side walls 21.

The scissors 11 may be used in this state with the blades 13*a* and 13*b* retained in the scissor cap 19. The operation of the scissors 11 in such state will now be discussed with reference to FIG. 1.

As shown in FIG. 1, when the blades 13*a* and 13*b* of the scissors 11 are retained in the cap body 20 and the scissor pieces 12 are opened, an object is inserted through the distal slit 23 of the cap body 20. Then, the handles 14 of the scissors 11 are closed (moved toward each other) against the urging force of the coil springs 18 and opened (moves away from each other) to cut the object. In this state, the head 15*a* of the pin 15 in the scissors 11 is engaged with the holding portion 25 and prevent the blades 13*a* and 13*b* from falling out of the cap body 20.

When the two blades 13*a* and 13*b* are opened or closed, an intersecting point Cp of the respective cutting edges 131*a* and 131*b* move along a predetermined movement path C. The distal slit 23 of the cap body 20 lies along the movement path C when the blades 13*a* and 13*b* are held on the cap body 20.

The movement path C extends straight. The distal slit 23, which extends along the movement path C, has a uniform width. Referring to FIG. 1, the distal slit 23 extends from the distal end of the cap body 20 to a portion of the cap body 20 corresponding to an initial intersecting point Cpo when the blades 13*a* and 13*b* are held in the cap body 20. The initial intersecting point Cpo refers to the intersecting point Cp of the cutting edges 131*a* and 131*b* when the scissor pieces 12 are opened as wide as possible in the cap body 20.

The removal of the blades 13*a* and 13*b* of the scissors 11 from the cap body 20 will now be discussed with reference to FIG. 5.

As shown in FIG. 5, in a state in which the blades 13*a* and 13*b* are retained in the cap body 20, the handles 14 of the scissors 11 are closed against the urging force of the coil springs 18. In this state, while holding the handles 14, the cap body 20 is pulled away from the blades 13*a* and 13*b*. This disengages the pin 15 of the scissors 11 from the holding portion 25 of the cap body 20. By further pulling away the cap body 20, the guiding portion 24 guides the pin 15 as the blades 13*a* and 13*b* are removed from the cap body 20.

The first embodiment has the advantages described below.

(1) The scissor cap 19 includes the engaging slit K and the distal slit 23. The simple structure of the engaging slit K prevents the blades 13*a* and 13*b* from falling out of the scissor cap 19. Further, the engaging slit K (holding portion 25) is engaged with and disengaged from the pin 15 to retain the blades 13*a* and 13*b* in the scissor cap 19 or remove the scissor cap 19 from the blade 13*a* and 13*b*. Accordingly, the scissor cap 19 is easily attached to and detached from the blades 13*a* and 13*b*. Further, the pin 15 may be disengaged from the engaging slit K (holding portion 25) to remove the blades 13*a* and 13*b* from the scissor cap 19 and retain the blades 13*a* and 13*b* of another pair of scissors 11 in the scissor cap 19. Accordingly, the scissor cap 19 is a general-purpose cap that may be used for multiple scissors 11. Further, when the blades 13*a* and 13*b* are retained in the scissor cap 19, an object may be inserted in the distal slit 23 and cut. Accordingly, in addition to when the scissors 11 are not being used, the blades 13*a* and 13*b* may also be retained in the scissor cap 19 when using the scissors 11. This improves the safety of the scissors 11. Accordingly, the scissors 11 may be safely used even by a small child.

(2) The structure of the scissor cap 19, which includes the engaging slit K and the distal slit 23, is simple. In the prior art cover 56 for the scissors 51, the cover 56 is formed integrally with one handle 54*a*. Thus, the structure for improving the safety of the scissors 51 during usage is complicated. In comparison, the scissor cap 19 of the first embodiment improves the safety of the scissors 11 regardless of whether or not the scissors 11 are being used. Further, the cover 56 of the scissors 51 interferes with the cutting of an object since it is formed integrally with one handle 54*a*. However, the scissor cap 19 may be used with both blades

13*a* and 13*b* retained in the cover 56 and does not interfere with the cutting of an object. In the prior art case 67 for the scissors 61, the burdensome task of projecting the two blades 63 out of the case 67 from the opening 67*a* must be performed to use the scissors 61. In comparison, with the scissor cap 19, the scissors 11 may be used in a state in which the blades 13*a* and 13*b* are retained in the scissor cap 19. Thus, a burdensome task does not have to be performed to use the scissors 11. Furthermore, trimmings from a cut object may enter the cover 56 since the cover 56 is formed integrally with the handle 54*a*. In such a case, it may be difficult to remove the trimmings from the cover 56. In comparison, in the scissor cap 19 of the first embodiment, the blades 13*a* and 13*b* are removed from the scissor cap 19 by disengaging the pin 15 from the engaging slit K. Thus, trimmings may easily be removed from the scissor cap 19.

(3) The holding portion 25 is connected with the distal side of the guiding portion 24.

Accordingly, the pin 15 is smoothly guided into the holding portion 25 when retaining the blades 13*a* and 13*b* of the scissors 11 in the scissor cap 19. This enables smooth movement when retaining the blades 13*a* and 13*b* in the scissor cap 19.

(4) The diameter of the holding portion 25 is greater than the width of the distal side of the guiding portion 24. This prevents the pin 15 of the scissor 11 from being easily disengaged from the holding portion 25 when the pin 15 is engaged with the holding portion 25.

(5) The engaging slit K includes the cutout portion 26. This enables the diameter of the holding portion 25 to be greater than the width of the distal side of the guiding portion 24. In other words, the width of the distal side of the guiding portion 24 may be smaller than the diameter of the head 15*a* of the pin 15. This prevents the pin 15 from being easily disengaged from the holding portion 25.

(6) The two side walls 21 of the cap body 20 are formed so that the basal side of their middle portions is curved toward each other. Thus, the retaining space S is narrow near the distal side of the holding portion 25. This prevents the cap body 20 from moving loosely on the blades 13*a* and 13*b*. More specifically, the blades 13*a* and 13*b* contact the curved portions on the inner surfaces of the side walls 21. Thus, when the scissors 11 are not being used, the cap body 20 does not move loosely on the blades 13*a* and 13*b*.

(7) The lateral sides of the cap body 20 are curved so as to partially narrow the cap body 20. Thus, by holding the sides of the cap body 20, the blades 13*a* and 13*b* of the scissors 11 are smoothly retained in and removed from the scissor cap 19. Further, the narrowed cap body 20 decreases the material cost of the scissor cap 19.

(8) The scissors 11 includes the pair of coil springs 18 that urge the two scissor pieces 12 away from each other in the opening direction. Thus, when cutting an object, only force for closing the scissor pieces 12 is applied to the handles 14. This smoothes the cutting movements of the scissors 11. Further, the urging force of the two coil springs 18 cause the two blades 13*a* and 13*b* to contact the inner surfaces of the two side walls 21 of the cap body 20 when the scissors 11 are not being used. This prevents the blades 13*a* and 13*b* from moving loosely in the cap body 20. In addition, when the scissors 11 are not being used, the two blades 13*a* and 13*b* are not exposed from the distal slit 23. This further improves the safety of the scissors 11.

(9) The width of the guiding portion 24 increases at portions closer to the basal side. Thus, the width of the basal side of the guiding portion 24 is greater than the width of the distal side of the guiding portion 24, which is slightly less than the diameter of the head 15*a* of the pin 15. This smoothly guides the head 15*a* of the pin 15 into the guiding portion 24 from the basal side of the guiding portion 24.

(10) The scissor cap 19 is transparent. This eliminates a sense of awkwardness when using the scissors 11 with the blades 13*a* and 13*b* retained in the scissor cap 19.

(11) The handles 14 produce sounds using the same principle as a castanet and make the scissors 11 interesting.

A second embodiment according to the present invention will now be discussed with reference to FIG. 6.

To avoid redundancy, like or same reference numerals are given to those components that are the same as the corresponding components in the scissor cap 19 and scissors 11 of the first embodiment. The description centers on parts differing from the first embodiment.

Figure 6A:
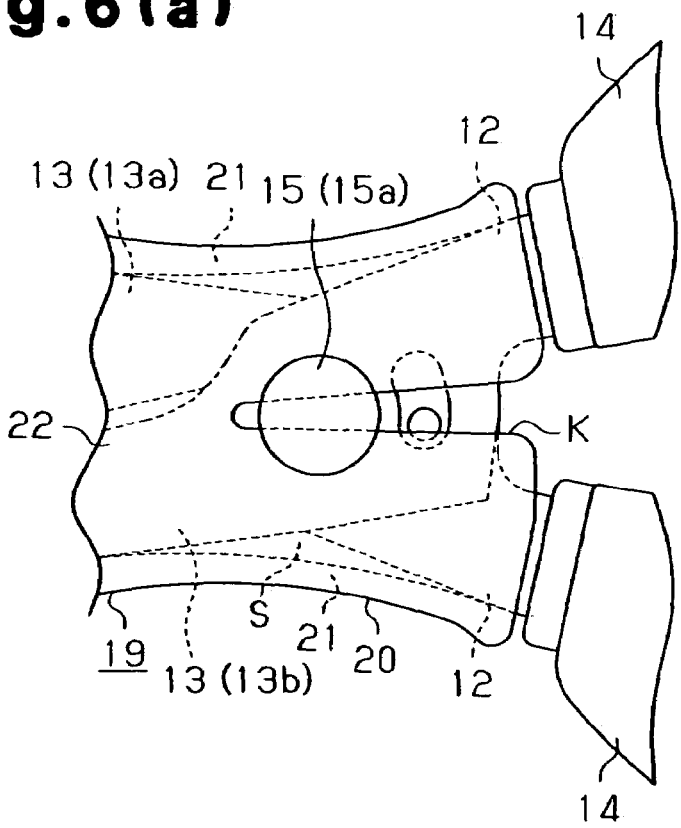
FIG. 6(*a*) is a partially cutaway plan view showing the vicinity of the pin of the scissors in a state in which the blades are accommodated in a scissor cap according to a second embodiment of the present invention.
Figure 6B:
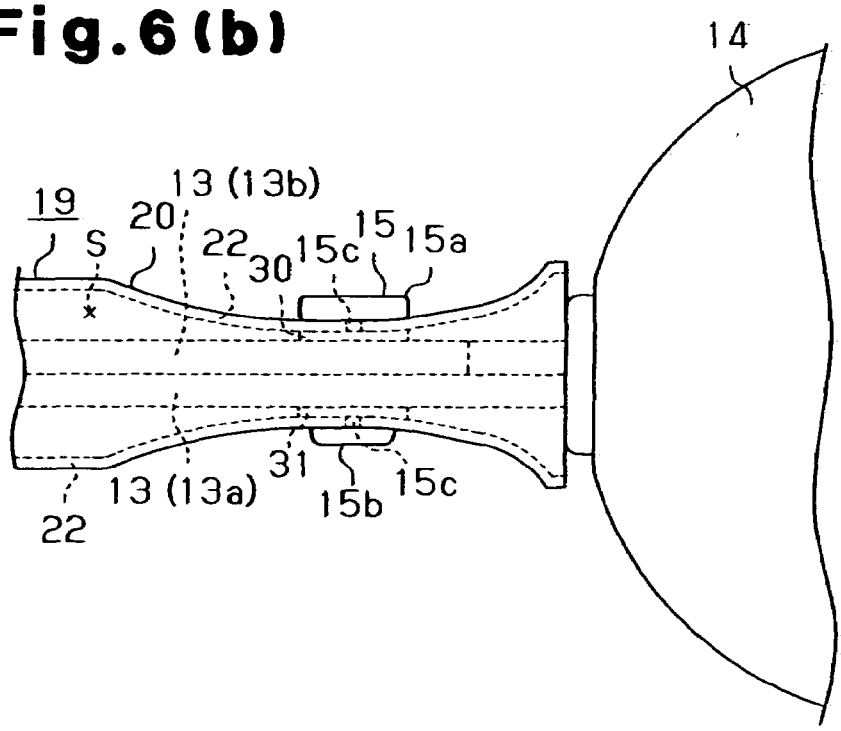

Referring to FIG. 6(*b*), in the second embodiment, the pin 15 of the scissors 11 includes disk-like seats 30 and 31. The seat 30 is arranged between the head 15*a* and the second blade 13*b*, and the seat 31 is arranged between the head 15*b* and the first blade 13*a*. The distance between the opposing surfaces of the head 15*a* and the seat 30 and the distance between the opposing surfaces of the head 15*b* and the seat 31 are about the same as the thickness of each cover wall 22.

Further, as shown in FIGS. 6(*a*) and 6(*b*), the cover walls 22 of the cap body 20 are curved so that the cover walls 22 approach each other from the longitudinally middle portion to the basal side of the cap body 20. Although not shown in the drawings, the laterally middle portion of the cap body 20 between the deepest curved portion of the cover walls 22 and the basal end of the cap body 20 is substantially flat. The cap body 20 also includes the engaging slit K. The engaging slit K extends through the center of each cover walls 22 so as to laterally divide each cover wall 22 in half. The engaging slit K narrows toward the distal end. The pin 15 has a shaft portion 15*c* that extends between the heads 15*a* and 15*b*. The width at an intermediate portion of the engaging slit K is about the same as the outer diameter of the shaft portion 15*c* between the seat 30 and the head 15*a* and between the seat 31 and the head 15*b*. The intermediate portion corresponds to the deepest curved portion of each cover wall 22.

When retaining the two blades 13*a* and 13*b* in the scissor cap 19, the shaft portion 15*c* of the pin 15 is inserted in the engaging slit K so that the opposing edges of the engaging slit K in the cover walls 22 are fitted between the seat 30 and the head 15*a* and between the seat 31 and the head 15*b*. In this manner, the shaft portion 15*c* of the pin 15 is guided to the deepest curved portion of the cover walls 22 with the opposing edges of the engaging slit K in the cover walls 22 held between the seat 30 and the head 15*a* and between the seat 31 and the head 15*b*. Then, the pin 15 (shaft portion 15*c*) is engaged with the engaging slit K and held in the engaged state. In other words, contact between the outer surface of the shaft portion 15*c* and the opposing edges of the engaging slit K in the cover walls 22 holds the shaft portion 15*c* from a direction that is substantially perpendicular to the axis of the pin 15. Further, the deepest curved portion of the cover walls 22 is held between the seat 30 and the head 15*a* and between the seat 31 and the head 15*b*.

In addition to advantages (1), (2), (6) to (8), (10), and (11), the second embodiment has the advantages described below.

(12) The pin 15 of the scissors 11 includes the heads 15*a* and 15*b* and the seats 30 and 31, and the scissor cap 19 (cap body 20) includes the engaging slit K. When the pin 15 (shaft portion 15*c*) of the scissors 11 is engaged with the engaging slit K, the pin 15 is prevented from being easily disengaged from the engaging slit K.

A third embodiment according to the present invention will now be discussed with reference to FIGS. 7 and 8.

To avoid redundancy, like or same reference numerals are given to those components that are the same as the corresponding components in the scissor cap 19 and scissors 11 of the first embodiment. The description centers on parts differing from the first embodiment. In the following description of the cap body 20, when the blades 13*a* and 13*b* are retained in the scissor cap 19 as shown in the state of FIG. 8, the cover wall 22 closer to the second blade 13*b* is referred to as a second cover wall 22*b*, and the cover wall 22 closer to the first blade 13*a* is referred to as a first cover wall 22*a*. Further, the side wall 21 closer to the second blade 13*b* is referred to as a second side wall 21*b*, and the side wall 21 closer to the first blade 13*a* is referred to as a first side wall 21*a*.

Figure 7A:
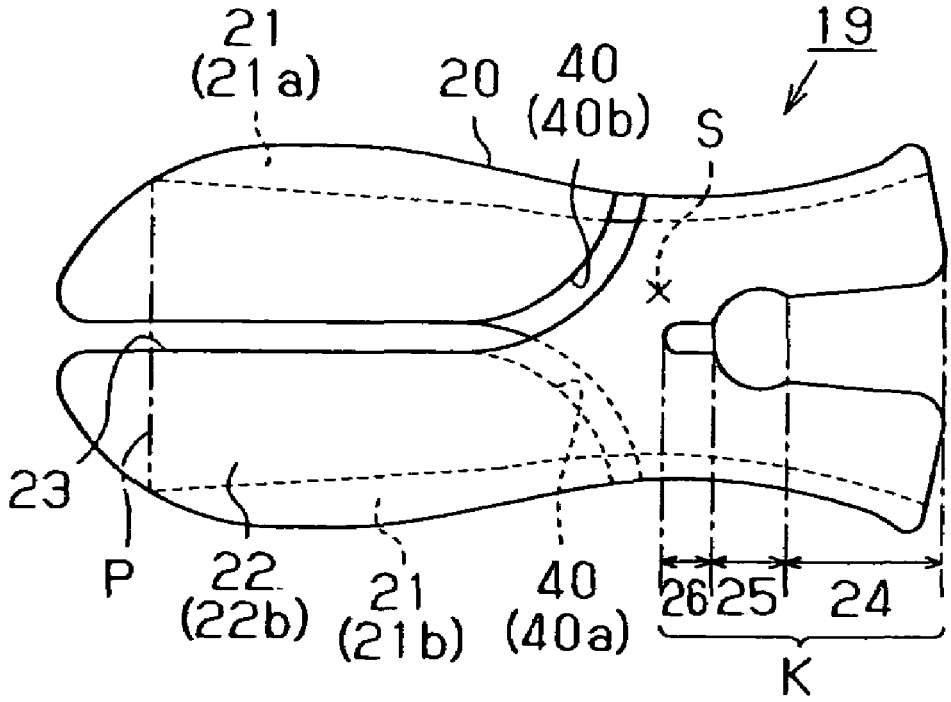
FIG. 7(*a*) is a plan view showing a scissor cap according to a third embodiment of the present invention.
Figure 7B:
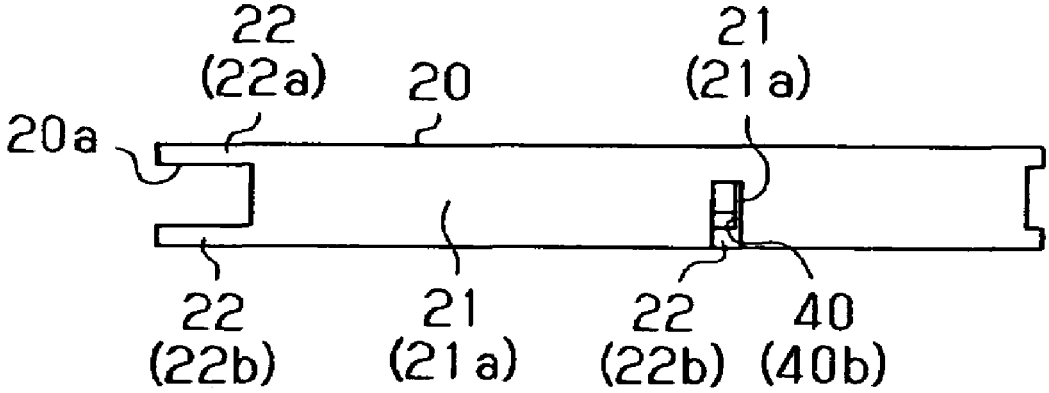

As shown in FIGS. 7(*a*) and 7(*b*), each cover wall 22 of the cap body 20 includes a guide 40, which is connected with the basal side of the distal slit 23. The guide 40 extends away from the distal slit 23 (i.e., movement path C of the intersecting point Cp of the two cutting edges 131*a* and 131*b*). More specifically, the guide 40 extends from the distal slit 23 toward a lateral side of the cap body 20. The guide 40 is arcuate and extends toward the basal side of the cap body 20 from the scissor pieces 12 when the scissor pieces 12 are retained in the cap body 20. The guide 40 guides a cut object, or paper Pa (refer to FIG. 8), from the distal slit 23 and outward of the cap body 20. In the following description, the guide 40 on the second cover wall 22*b* of the cap body 20 is referred to as a second guide 40*b*, and the guide 40 on the first cover wall 22*a* is referred to as a first guide 40*a*.

In the cap body 20, the second guide 40*b* extends along the second cover wall 22*b* to the first side wall 21*a*. Further, the first guide 40*a* extends along the first cover wall 22*a* to the second side wall 21*b*. Referring to FIG. 7(*a*), when the second cover wall 22*b* is viewed from above, the guides 40*a* and 40*b* are symmetrical to each other about a hypothetical line that divides the cap body 20 into two halves. The guides 40*a* and 40*b* are also symmetrical to each other in the same manner when the first cover wall 22*a* is seen from above. Accordingly, among the two guides 40*a* and 40*b*, only the second guide 40*b* will be described below.

As shown in FIG. 7(*a*), the second guide 40*b* is a slit extending from the basal side of the distal slit 23 in the second cover wall 22*b* and formed by cutting out the second cover wall 22*b* in a direction perpendicular to the second cover wall 22*b*. The second guide 40*b* extends from the basal side of the distal slit 23 to the edge of the first side wall 21*a*. Further, as shown in FIG. 7(*b*), in the first side wall 21*a*, the second guide 40*b* extends from the edge connected with the second cover wall 22*b* to a position close to the first cover wall 22*a*.

Figure 8:
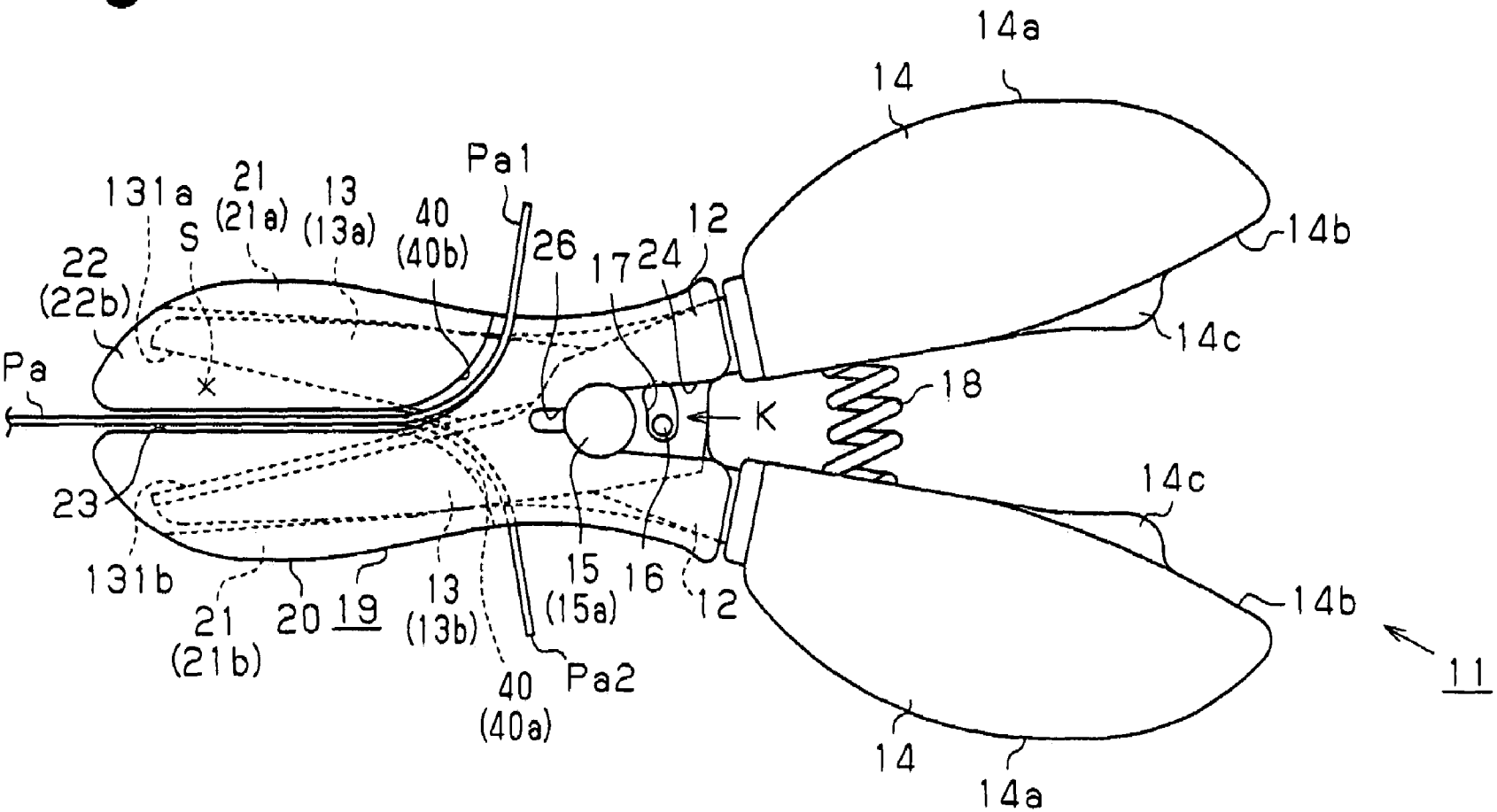
FIG. 8 is a plan view showing the scissor cap of FIG. 7(*a*) in a state accommodating the blades of a pair of scissors when cutting a piece of paper.
Figure 9:
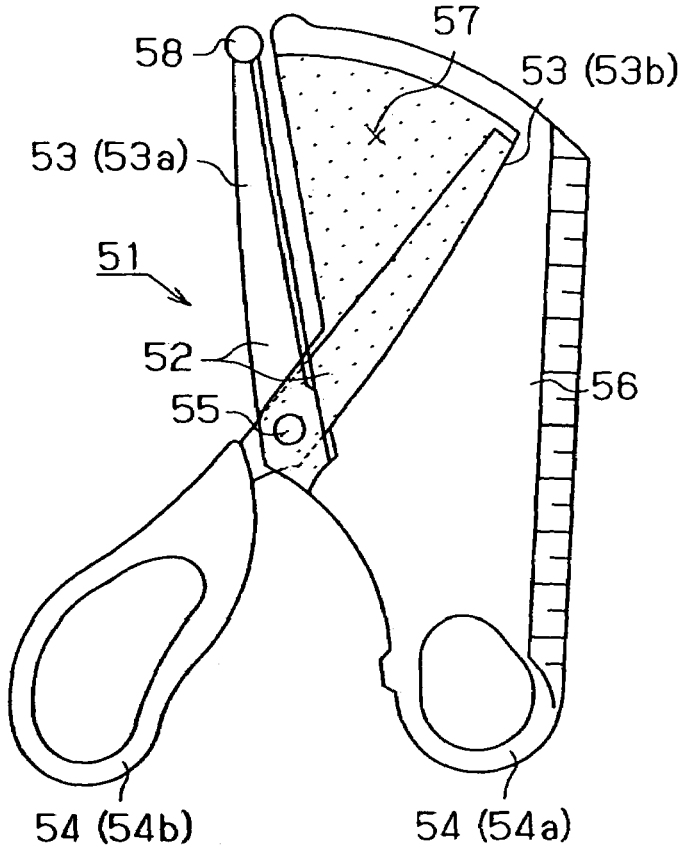
Fig.9(Prior Art)
FIG. 9 is a plan view showing a pair of scissors with a prior art cover.
Figure 10:
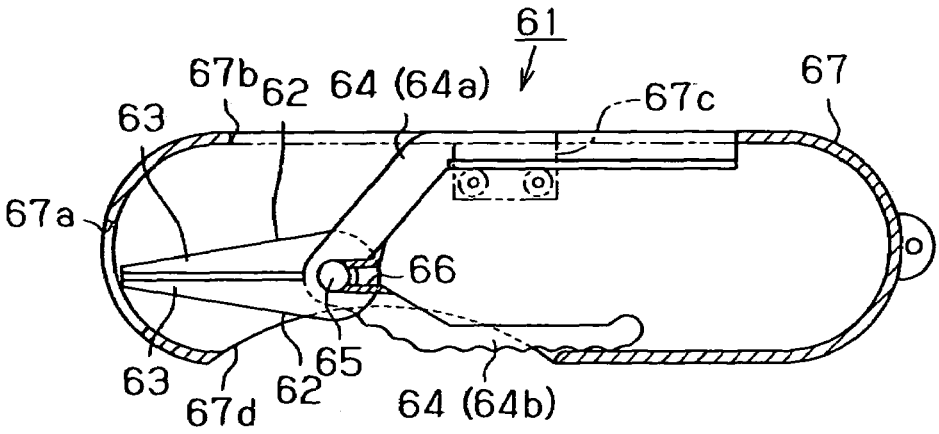
Fig.10(Prior Art)
FIG. 10 is a plan view showing a pair of scissors with a prior art case.

When the blades 13*a* and 13*b* are retained in the scissor cap 19 as shown in the state of FIG. 8, the second guide 40*b* extends away from the second blade 13*b* along the second cover wall 22*b* from the basal side of the distal slit 23 to the edge connected with the first side wall 21*a*. The first guide 40*a* extends away from the first blade 13*a* along the first cover wall 22*a* from the basal side of the distal slit 23 to the edge connected with the second side wall 21*b*.

As shown in FIG. 7(*a*), the second guide 40*b* is arcuate and extends toward the basal side of the cap body 20. Further, the width of the second guide 40*b* is the same as the width of the distal slit 23.

The operation of the scissors 11 when the blades 13*a* and 13*b* are retained in the scissor cap 19 will now be discussed with reference to FIG. 8.

When the blades 13*a* and 13*b* of the scissors 11 are retained in the cap body 20 with the scissor pieces 12 in an opened state, a piece of paper Pa is inserted in the distal slit 23 of the cap body 20. Then, the handles 14 of the scissors 11 are closed and opened to cut the paper Pa. The cut paper Pa is guided out of the cap body 20 from the distal slit 23 by the guides 40*a* and 40*b*. More specifically, referring to FIG. 8, the cut paper Pa is cut into a paper section Pa1 and a paper section Pa2. The paper section Pa1 on the second cover wall 22*b* (front side as viewed in FIG. 8) is guided along the second guide 40*b* from the distal slit 23 and discharged out of the cap body 20 from the first side wall 21*a*. In the same manner, the paper section Pa2 on the first cover wall 22*a* (front side as viewed in FIG. 8) is guided along the first guide 40*a* from the distal slit 23 and discharged out of the cap body 20 from the second side wall 21*b*.

In this manner, the paper sections Pa1 and Pa2 are guided in opposite directions along the cap body 20. More specifically, the second guide 40*b* guides the paper section Pa1 away from the second blade 13*b*, and the first guide 40*a* guides the paper section Pa2 away from the first blade 13*a*. This is because at the point in which the two blades 13*a* and 13*b* cut the paper Pa, the second blade 13*b* pushes the paper section Pa1 toward the first side wall 21*a*, and the first blade 13*a* pushes the paper section Pa2 toward the second side wall 21*b*.

In addition to advantages (1) to (11) of the first embodiment, the third embodiment has the advantages described below.

(13) The scissor cap 19 includes the guide 40. The guide 40 guides the paper Pa cut by the blades 13*a* and 13*b* (paper sections Pa1 and Pa2) out of the cap body 20 from the distal slit 23. This prevents the paper sections Pa1 and Pa2 from remaining in the distal slit 23 and smoothly guides the paper sections Pa1 and Pa2 out of the cap body 20. Further, since the paper sections Pa1 and Pa2 do not remain in the distal slit 23, the paper sections Pa1 and Pa2 are not bent in the distal slit 23. When using conventional scissors, a person holds the scissors with one hand and supports the cut section of a piece of paper with the other hand. However, when using the scissor cap 19, the guide 40 enables a person to cut a piece of paper Pa with the scissors 11 without having to support the cut paper sections Pa1 and Pa2 with one hand.

(14) The second guide 40*b* guides the paper section Pa1 from the distal slit 23 to the first side wall 21*a* and out of the cap body 20. In the same manner, the first guide 40*a* guides the paper section Pa2 from the distal slit 23 to the second side wall 21*b* and out of the cap body 20. Accordingly, the paper sections Pa1 and Pa2 are not discharged from the basal side of the cap body 20, or the side of the cap body 20 at which the handles 14 are located. Thus, the person using the scissors 11 may avoid contact with the paper sections Pa1 and Pa2.

(15) The guides 40*a* and 40*b* are arcuate. This smoothly guides the paper sections Pa1 and Pa2 out of the cap body 20.

(16) The distance between the handles 14 and the basal ends of the guides 40*a* and 40*b* must be long so that the paper sections Pa1 and Pa2 guided out of the cap body 20 by the guides 40*a* and 40*b* do not contact the hand of the person (i.e., hand holding the handles 14) using the scissors 11. However, to increase the distance, the angle formed between the distal slit 23 and the second guide 40*b* (or the first guide 40*a*) must be decreased. As a result, it would become difficult for the second guide 40*b* (or first guide 40*a*) to smoothly guide the paper section Pa1 (or paper section Pa2) from the distal slit 23 and out of the cap body 20. Therefore, in the third embodiment, the guides 40*a* and 40*b* are curved toward the basal side of the cap body 20. Accordingly, the paper sections Pa1 and Pa2 are smoothly guided out of the cap body 20 from the distal slit 23 even though the distance between the handles 14 and the basal ends of the guides 40*a* and 40*b* is long.

(17) The paper sections Pa1 and Pa2 are guided in opposite directions on the cap body 20. The second guide 40*b* guides the paper section Pa1 away from the second blade 13*b*, and the first guide 40*a* guides the paper section Pa2 away from the first blade 13*a*. When cutting the paper Pa, the second blade 13*b* (or first blade 13*a*) pushes the paper section Pa1 (or paper section Pa2) away from the second blade 13*b* (or first blade 13*a*). Since the second guide 40*b* (or first guide 40*a*) extends in the direction in which the second blade 13*b* (or first blade 13*a*) pushes the paper section Pa1 (or paper section Pa2), the paper section Pa1 (or paper section Pa2) is smoothly pushed out of the distal slit 23 toward the second guide 40*b* (or first guide 40*a*). Further, the paper section Pa1 (or paper section Pa2) is smoothly pushed out of the cap body 20 from the second guide 40*b* (or first guide 40*a*).

It should be apparent to those skilled in the art that the present invention may be embodied in many other specific forms without departing from the spirit or scope of the invention. Particularly, it should be understood that the present invention may be embodied in the following forms.

In each of the above embodiments, slip-guards may be provided on the lateral sides of the cap body 20. For example, the outer surface of each side wall 21 of the cap body 20 may have a rough texture to function as a slip-guard. Such a structure also has the same advantages as the above embodiments.

In each of the above embodiments, two coil springs 18 are arranged between the handles 14. However, any number of coil springs 18, for example one or three, may be arranged between the handles 14.

In each of the above embodiments, a leaf spring or Belleville spring may be used as the urging member in lieu of each coil spring 18. Further, an urging member does not necessarily have to be arranged between the handles 14.

In the first and third embodiments, the guiding portion 24 widens at locations closer to the basal end of the cap body 20. However, the width may be the same throughout the guiding portion 24.

In each of the above embodiments, the blades 13*a* and 13*b* and the handles 14 of the scissors 11 may be shaped in any manner. For example, the blades 13*a* and 13*b* may have round distal ends. Alternatively, the stopper 14*c* may be eliminated from each handle 14. When the stoppers 14*c* are eliminated from the handles 14, the spherical portions 14*a* may be hollow. Further, a mechanism for holding the handles 14 in a closed state may be provided at the basal side of the handles 14.

In each of the above embodiments, the lateral sides of the cap body 20 are curved so that the width of the cap body 20 decreases. However, the width may be changed in accordance with the design of the cap body 20. For example, the width may be the same throughout the cap body 20. Alternatively, the cap body 20 may be curved outward so that the width of the cap body 20 increases.

In the first and third embodiments, the engaging slit K includes the cutout portion 26. However, the cutout portion 26 may be eliminated.

In each of the above embodiments, the scissors 11 and the cap body 20 are held in an engaged state by the convexo-concave relationship between the engaging slit K and the pin 15. However, one of the blades 13*a* and 13*b* may be detachably engaged with the cap body 20 when the blades 13*a* and 13*b* of the scissors 11 are retained in the cap body 20. For example, one of the blades 13*a* and 13*b* may be detachably engaged with one of the side walls 21, and an engaging mechanism may be used to maintain the engaged state. In such a case, the blade 13*a* or 13*b* that is held by the engaging mechanism may be longer than the other blade 13*a* or 13*b*. Further, the scissor cap 19 may include the engaging slit K of the above embodiments in addition to the engaging mechanism that detachably engages one of the blades 13*a* and 13*b* with the scissor cap 19. In each of these structures provided with an engaging mechanism that detachably engages one of the blades 13*a* and 13*b* with the scissor cap 19, the movement path C of the intersecting point Cp of the two cutting edges 131*a* and 131*b* extends straight. The distal slit is formed along the movement path C with a uniform width. Such a structure stably holds the cap body 20 with respect to the blades 13*a* and 13*b* when the blades 13*a* and 13*b* are opened and closed.

In each of the above embodiments, the cap body 20 may have any structure as long as it has the two side walls 21 and the two cover walls 22. For example, outer walls may be formed on the outer side of the side walls 21. In such a case, the contour of the cover walls 22 corresponds to the outer surface of the outer walls. In such a case, in the cap body 20 of the third embodiment, the guides 40*a* and 40*b* extend to the outer walls.

In the first and third embodiments, the engaging slit K may have only the holding portion 25. That is, the guiding portion 24 and the cutout portion 26 may be eliminated from the engaging slit K. In such a case, the holding portion 25 is formed in the basal side of the cap body 20.

In each of the above embodiments, the engaging slit K may be formed in the opposing surfaces of the cover walls 22 to establish a convexo-concave relationship in the axial direction of the pin 15.

In each of the above embodiments, the engaging slit K is used to engage the pin 15. However, projections may be engaged with the pin 15. In this case, the portions of the scissors 11 corresponding to the pin 15 are recessed in the surface of the blades 13*a* and 13*b* to receive the projections.

In each of the above embodiments, the distal slit 23 is straight. However, the distal slit 23 is required to extend along only part of the movement path C. In other words, it is only required that the distal slit 23 be formed in correspondence with at least part of the movement path C. For example, the distal slit 23 may be formed extending from an intermediate section of the movement path C to the distal side of the cap body 20, and the cap body 20 may be widened at portions closer to the distal end. Further, elongated holes may be formed in the cover walls 22 of the cap body 20 along an intermediate section or basal section of the hypothetical line. The hole corresponds to the distal slit 23. Further, the cap body 20 may have more than one distal slit 23. For example, distal slits may extend radially toward the distal side of the cap body 20 from a portion corresponding to the initial intersecting point Cpo when the blades 13*a* and 13*b* are held in the cap body 20.

The engaging slit K in the second embodiment may be such that the width of the engaging slit K is uniform between an intermediate section of the engaging slit K to the distal end of the engaging slit K. Further, the width of the engaging slit K may be uniform in the longitudinal direction of the engaging slit K.

The basal side of the cap body 20 may have any shape as long as the blades 13*a* and 13*b* may be inserted therein and the engaging slit K may be formed therein.

In the third embodiment, the second guide 40*b* does not have to be formed extending away from the second blade 13*b*, and the first guide 40*a* does not have to be formed extending away from the first blade 13*a*. In other words, it is required only that the guides 40*a* and 40*b* are connected continuously with the distal slit 23 and extend away from the distal slit 23 so that the paper sections Pa1 and Pa2 are guided out of the cap body 20 from the distal slit 23. For example, the two guides may be formed from the basal side of the distal slit 23 to the basal side of the cap body 20. In this case, the guides are formed so that the side walls at the basal ends of the guides are inclined toward the outer surface of the cover walls 22 and toward the basal side of the cap body 20. In other words, the guides extend diagonally toward the outer surface of the cover walls 22 from the basal side of the distal slit 23.

In the third embodiment, the paper section Pa1 (or paper section Pa2) is guided (discharged) out of the first side wall 21*a* (or second side wall 21*b*) from the distal slit 23 along the second guide 40*b* (or first guide 40*a*) in the lateral direction of the cap body 20. However, the guides 40*a* and 40*b* are required only to guide the paper sections Pa1 and Pa2 out of the cap body 20 from the distal slit 23. For example, the guides 40*a* and 40*b* may guide the paper sections Pa1 and Pa2 toward the front and rear sides of the cap body 20 with respect to the plane of FIG. 8 or in directions opposite to the directions of the third embodiment.

In the third embodiment, the guides 40*a* and 40*b* are formed partially by the side walls 21*a* and 21*b*. However, the guides 40*a* and 40*b* may be formed entirely by the cover walls 22*a* and 22*b*.

In the third embodiment, the guides 40*a* and 40*b* are slit-like, and the accommodating space S of the cap body 20 is communicated to the atmosphere through the guides 40*a* and 40*b*. However, the guides 40*a* and 40*b* may be grooves that do not communicate the accommodating space S to the atmosphere. In this case, the distal sides of the guides 40*a* and 40*b* may be formed so that the bottom walls extend diagonally into the retaining space S.

In the third embodiment, the guides 40*a* and 40*b* extend from the distal slit 23 to the lateral sides of the cap body 20. However, the guides 40*a* and 40*b* are required only to extend from the guides 40*a* and 40*b* toward the lateral sides of the cap body 20. For example, the guides 40*a* and 40*b* may be formed extending to the vicinity of the lateral sides of the cap body 20. In this case, each guide extends diagonally toward the surface of the corresponding cover wall 22 as the lateral side of the cap body 20 becomes closer.

The guides 40*a* and 40*b* of the third embodiment may be used in the scissor cap 19 of the second embodiment.

In the third embodiment, the guides 40*a* and 40*b* are curved toward the basal side of the cap body 20. However, the guides 40*a* and 40*b* may be straight. Alternatively, the guides 40*a* and 40*b* may be formed in a meandering manner. Such forms may be employed when the guides 40*a* and 40*b* are grooves.

In the third embodiment, the cut object is described as being a piece of paper Pa. However, the cut object is not limited to paper Pa and may be, for example, a resin sheet or film. That is, the cut object may be any article that is sheet-like and can be inserted in the distal slit 23.

The present examples and embodiments are to be considered as illustrative and not restrictive, and the invention is not to be limited to the details given herein, but may be modified within the scope and equivalence of the appended claims.

What is claimed is:

1. A cap for a pair of scissors, the scissors including two scissor pieces, each having a handle and a blade provided with a cutting edge, and a pin connecting the two scissor pieces so as to enable the scissor pieces to be opened and closed, wherein the cutting edges of the two blades intersect each other at an intersecting point that moves along a predetermined movement path when the two blades are opened and closed, the cap comprising:

a cap body for accommodating the two blades;

an engaging portion detachably engaged with at least one of the pin and either one of the scissor pieces to keep the two blades accommodated in the cap body; and a slit formed in the cap body, wherein the slit is located at a portion of the cap body, which accommodates the two blades, corresponding to at least part of the movement path, the slit receiving an object that is to be cut by the cutting edges in the slit, wherein the cap body includes a guide extending continuously from the slit, the guide guiding the object after being cut out of the cap body.

2. The cap according to claim 1, wherein the movement path is substantially straight, and the slit extends along the movement path and has a uniform width.

3. The cap according to claim 1, wherein the slit extends along the movement path from a distal end of the cap body to a portion of the cap body corresponding to an initial intersecting point at which the two cutting edges intersect each other when the two blades are opened as wide as possible in the cap body.

4. The cap according to claim 1, wherein the guide extends outward from the slit in a lateral direction of the cap body.

5. The cap according to claim 1, wherein the guide is curved in an arcuate manner.

6. The cap according to claim 1, wherein the cap body includes two cover walls spaced from each other by a predetermined distance in an axial direction of the pin, and the guide is one of a pair of guides, each formed in one of the two cover walls, the pair of guides extending away from the slit in opposite directions.

7. The cap according to claim 1, wherein the cap body includes two cover walls, which are spaced from each other by a predetermined distance in an axial direction of the pin, and two side walls connecting the two cover walls to each other, the side walls being curved toward each other.

8. The cap according to claim 7, wherein the distance between inner surfaces of the two side walls is determined so that the two blades in the cap body come into contact with the inner surfaces of the two side walls.

9. The cap according to claim 1, wherein the two sides of the cap body, with respect to a lateral direction of the cap body, are curved to partially narrow the cap body.

10. The cap according to claim 1, wherein the cap body includes two side walls with respect to a lateral direction of the cap body, the outer surface of each side wall having a rough texture.

11. The cap according to claim 1, wherein the engaging portion is an engaging slit for engaging a head of the pin projecting from the two scissor pieces.

12. The cap according to claim 11, wherein the cap body includes a basal end provided with an opening, with the two blades being inserted in the cap body through the opening, and the engaging slit extending toward a distal end of the cap body from the basal end.

13. The cap according to claim 12, wherein the engaging slit includes a guiding portion extending from the basal end toward the distal end of the cap body and a holding portion connected to the guiding portion, the guiding portion guiding the head of the pin toward the holding portion when the two blades are inserted in the cap body, and the holding portion engaging and holding the head of the pin.

14. The cap according to claim 13, wherein the width of the guiding portion varies from the basal end toward the distal end of the cap body between a width that is greater than a diameter of the head of the pin and a width that is smaller than the diameter of the head of the pin.

15. The cap according to claim 14, wherein the diameter of the holding portion is substantially the same as the diameter of the head of the pin.

16. The cap according to claim 13, wherein the engaging slit further includes a cutout portion extending from the holding portion toward the distal end of the cap body.

17. A pair of scissors comprising:

two scissor pieces, each having a handle and a blade provided with a cutting edge;

a pin connecting the two scissor pieces so as to enable the scissor pieces to be opened and closed, wherein the cutting edges of the two blades intersect each other at an intersecting point that moves along a predetermined movement path when the two blades are opened and closed;

a cap for accommodating the two blades, the cap including:

an engaging portion detachably engaged with at least one of the pin and either one of the scissor pieces to keep the two blades accommodated in the cap;

a slit formed in the cap, wherein the slit is located at a portion of the cap, which accommodates the two blades, corresponding to at least part of the movement path, the slit receiving an object that is to be cut by the cutting edges in the slit; and a guide formed in the cap, the guide extending continuously from the slit to guide the object after being cut out of the cap.

18. The scissors according to claim 17, further comprising an urging member for moving the two scissor pieces away from each other.

19. The scissors according to claim 18, wherein the urging member urges the two scissor pieces so that the two blades in the cap come into contact with an inner surface of the cap.

* * * * *